US008172514B2

(12) United States Patent
Durocher et al.

(10) Patent No.: US 8,172,514 B2
(45) Date of Patent: May 8, 2012

(54) RIM SEAL FOR A GAS TURBINE ENGINE

(75) Inventors: Eric Durocher, Vercheres (CA); Rene Paquet, Montréal (CA); Guy Lefebvre, Saint-Bruno (CA)

(73) Assignee: Pratt & Whitney Canada Corp., Longueuil (CA)

( * ) Notice: Subject to any disclaimer, the term of this patent is extended or adjusted under 35 U.S.C. 154(b) by 43 days.

(21) Appl. No.: 12/426,472

(22) Filed: Apr. 20, 2009

(65) Prior Publication Data

US 2009/0208326 A1 Aug. 20, 2009

Related U.S. Application Data

(62) Division of application No. 11/530,226, filed on Sep. 8, 2006, now abandoned.

(51) Int. Cl.
*F01D 11/12* (2006.01)

(52) U.S. Cl. ..... 415/136; 415/174.4; 416/193 A

(58) Field of Classification Search ..... 415/134, 415/136, 138, 139, 173.4, 173.5, 173.7, 174.3, 415/174.4, 174.5; 416/193 A; 277/411, 277/412, 415

See application file for complete search history.

(56) References Cited

U.S. PATENT DOCUMENTS

| | | | | |
|---|---|---|---|---|
| 2,564,503 | A | 8/1951 | Rice | |
| 3,023,998 | A | 3/1962 | Sanderson, Jr. | |
| 3,146,938 | A | 9/1964 | Smith | |
| 3,262,635 | A * | 7/1966 | Smuland | 415/173.7 |
| 3,606,349 | A | 9/1971 | Petrie et al. | |
| 3,755,870 | A | 9/1973 | Young et al. | |
| 3,761,200 | A | 9/1973 | Gardiner | |
| 3,841,792 | A | 10/1974 | Amos | |
| 3,908,361 | A | 9/1975 | Gardiner | |
| 3,918,925 | A | 11/1975 | McComas | |
| 4,084,919 | A | 4/1978 | Morris, Jr. et al. | |
| 4,309,145 | A | 1/1982 | Viola | |
| 4,320,903 | A | 3/1982 | Ayache et al. | |
| 4,415,309 | A | 11/1983 | Atterbury | |
| 4,747,750 | A | 5/1988 | Chlus et al. | |
| 4,813,848 | A | 3/1989 | Novotny | |
| 4,867,639 | A | 9/1989 | Strangman | |
| 5,217,348 | A | 6/1993 | Rup, Jr. et al. | |
| 5,228,195 | A | 7/1993 | Brown et al. | |
| 5,362,204 | A | 11/1994 | Matyscak et al. | |
| 5,522,698 | A * | 6/1996 | Butler et al. | 415/174.5 |
| 5,575,486 | A | 11/1996 | Edling et al. | |
| 5,601,404 | A | 2/1997 | Collins | |
| 5,785,492 | A | 7/1998 | Belsom et al. | |
| 5,962,076 | A | 10/1999 | Mason et al. | |
| 5,967,745 | A | 10/1999 | Tomita et al. | |
| 6,077,034 | A * | 6/2000 | Tomita et al. | 415/173.7 |
| 6,152,690 | A | 11/2000 | Tomita et al. | |
| 6,189,891 | B1 | 2/2001 | Tomita et al. | |
| 6,220,815 | B1 | 4/2001 | Rainous et al. | |
| 6,692,227 | B2 * | 2/2004 | Tomita et al. | 415/173.7 |
| 6,776,573 | B2 | 8/2004 | Arilla et al. | |
| 6,837,676 | B2 | 1/2005 | Yuri et al. | |
| 6,887,039 | B2 | 5/2005 | Soechting et al. | |
| 6,899,339 | B2 | 5/2005 | Sanders et al. | |
| 7,040,857 | B2 | 5/2006 | Chiu et al. | |
| 2006/0045732 | A1 | 3/2006 | Durocher et al. | |
| 2006/0277922 | A1 * | 12/2006 | Durocher et al. | 60/805 |
| 2008/0061515 | A1 | 3/2008 | Durocher et al. | |

* cited by examiner

*Primary Examiner* — Christopher Verdier
(74) *Attorney, Agent, or Firm* — Norton Rose Canada LLP

(57) ABSTRACT

The rim seal is positioned in an annular space between blades and a non-rotating adjacent structure in a gas turbine engine. The rim seal is connectable to the non-rotating structure and is made of an abradable material.

11 Claims, 2 Drawing Sheets

RIM SEAL FOR A GAS TURBINE ENGINE

CROSS-REFERENCE TO RELATED APPLICATION

The present patent application is a divisional of U.S. patent application Ser. No. 11/530,226, filed on Sep. 8, 2006, by the present applicants, now abandoned.

TECHNICAL FIELD

The invention relates generally to a rim seal for a gas turbine engine, and in particular to a rim seal for use within an annular space between rotating blades and a non-rotating adjacent structure in a gas turbine engine.

BACKGROUND

In a gas turbine engine, rotating elements, such as compressors and turbine rotors, operate at a very high rotation speed. Their blades are also subjected to intense pressure and heat.

Compressors and turbine rotors are mounted between non-rotating structures within the engine. These structures are designed to be as close as possible to the rotating blade platforms. This mitigates pressurized air ingestion inside the gas turbine engine.

Although various rim seal arrangements have been suggested in the past, there is always a need to provide an improved rim seal yielding better results than previous seals.

SUMMARY

In one aspect, the present concept provides a rim seal for an annular space between blade platforms and a non-rotating adjacent structure in a gas turbine engine, the rim seal being connectable to the non-rotating structure and made of an abradable material.

In a second aspect, the present concept provides an annular abradable rim seal for mitigating combustion gas ingestion on a side of blades in a gas turbine engine, the seal having an outer peripheral portion configured and disposed to be at least partially in friction engagement with blade platforms during operation of the engine.

In a third aspect, the present concept provides a method of sealing an annular space between blade platforms and a non-rotating structure immediately adjacent to the blade platforms in a gas turbine engine, the method comprising securing to the non-rotating structure an abradable annular seal provided in the annular space; and operating the gas turbine engine to carve a notch in the seal with the side of the blades.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION

Figure 1:
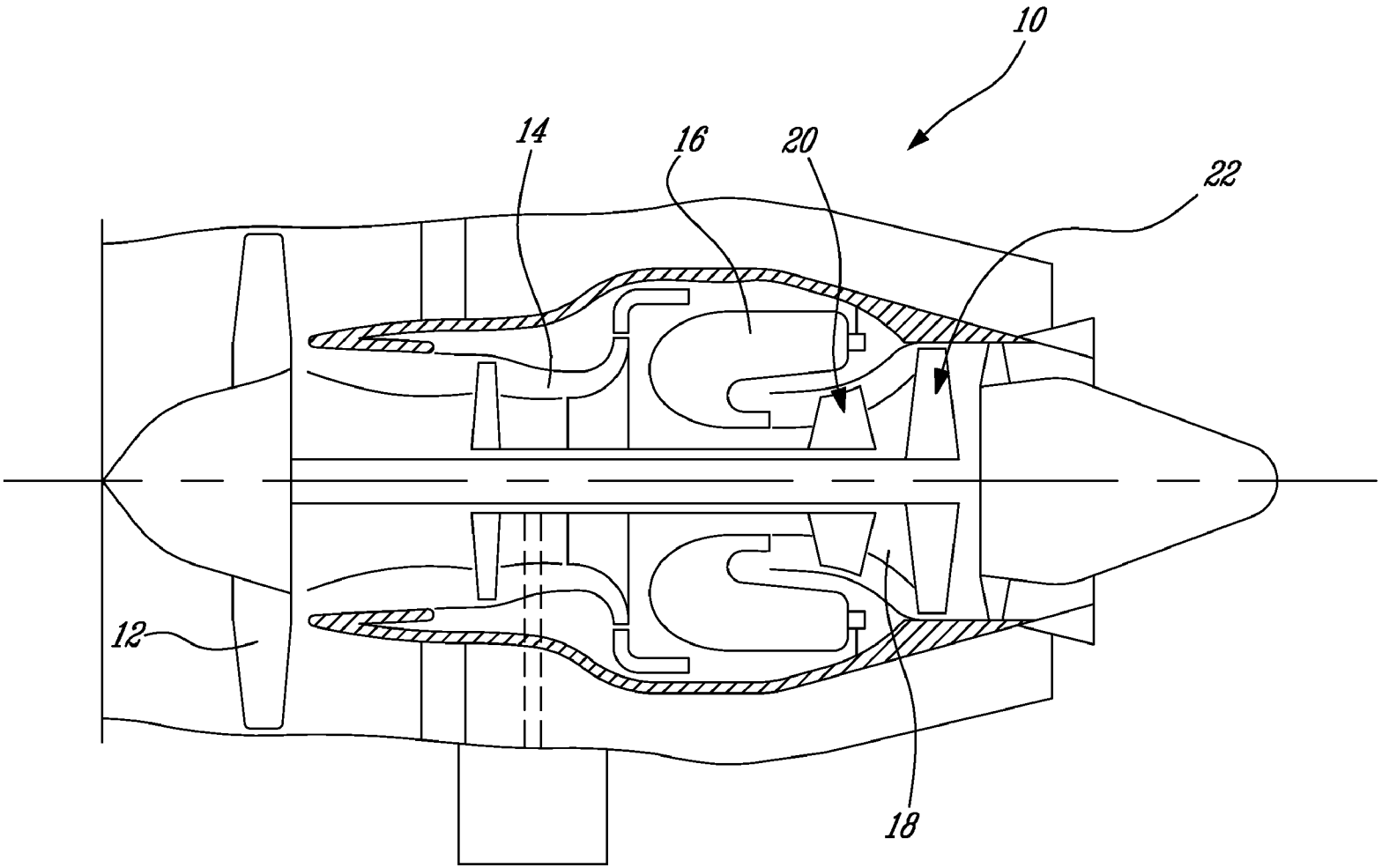
FIG. 1 is a schematic cross-sectional view of an example of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. In this example, the turbine section 18 includes a high pressure turbine stage 20 and a low pressure turbine stage 22.

Figure 2:
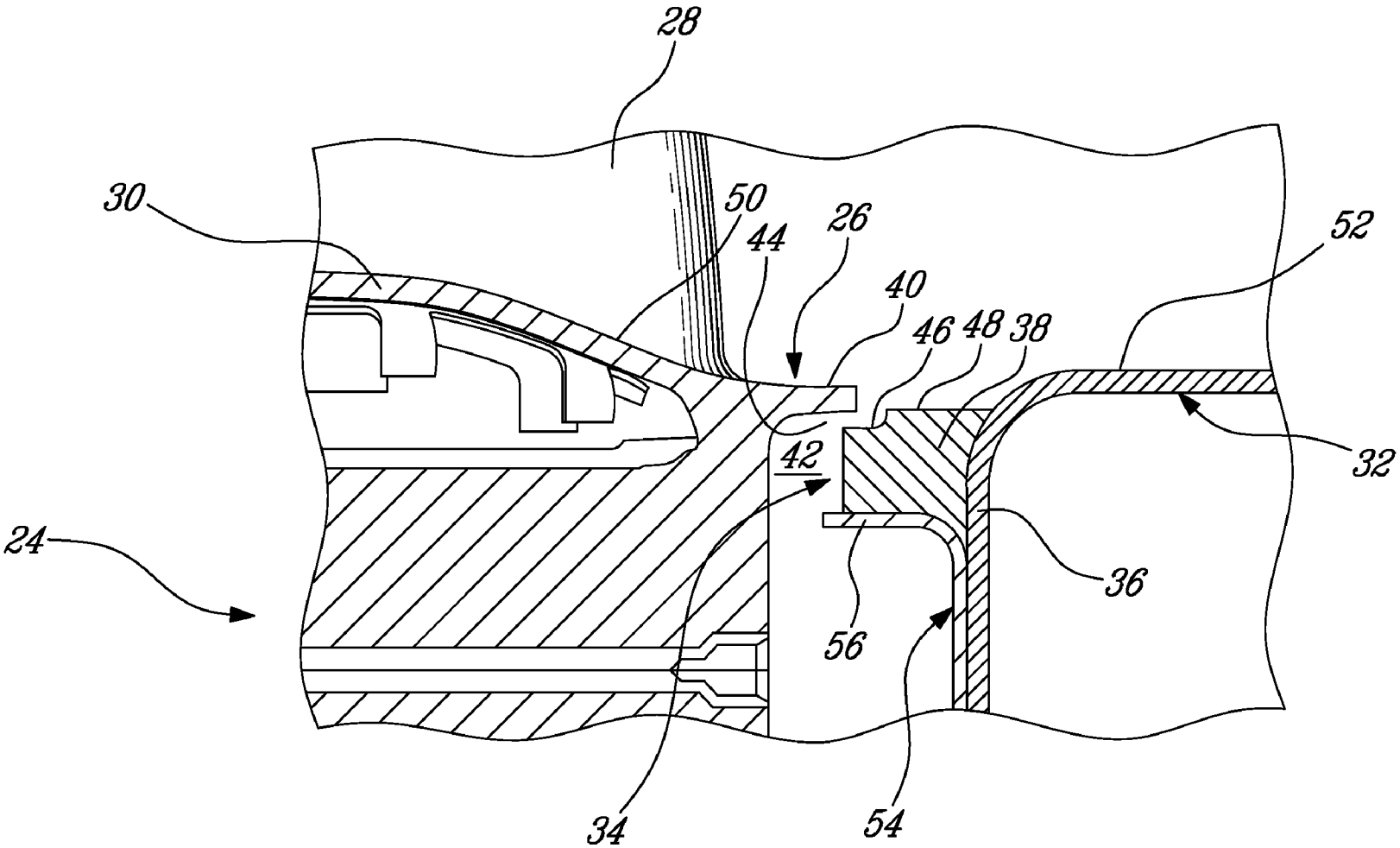
FIG. 2 is a schematic longitudinal cross-sectional view of an example of an improved rim seal.

FIG. 2 schematically shows the downstream side of a turbine wheel disc 24 which can be the rotor of either one of the high pressure turbine stage 20 or the low pressure turbine stage 22. The wheel disc 24 has a plurality of radially interspaced blades 26. In the figure, a blade 26 can be seen having an airfoil section 28 extending radially outwardly from a blade platform 30. A non-rotating structure 32 for instance made of sheet metal is present adjacent to the blades 26. The non-rotating structure 32 can be the inner wall of an interturbine duct in the case of the high pressure turbine stage 20 or the inner wall of an exhaust duct in the case of the low pressure turbine stage 22, for example, thereby defining a portion of the engine gas path.

It should be noted that the improved rim seal is not limited for use with turbine blades or at the outlet of a turbine stage. The rim seal can also be used on either sides of a compressor rotor or on the inlet of the turbine rotor.

An annular space 34 is defined immediately adjacent to the blades of the wheel disc 24, between the side of the blade platforms 30 and an end 36 of the non-rotating structure 32. A rim seal 38, connected to the end 36 of the non-rotating structure 32, substantially fills the inner side of the annular space 34. The rim seal 38 is made of an abradable material such as honeycomb-shaped light material, for example.

In the illustrated example, each blade platform 26 has a protruding portion 40 on the side thereof. Together, the protruding portion 40 defines an annular recess 42. The rim seal 38 is set within the annular recess 42 along an overlap distance with respect to the edge of the protruding portions 40. A gap 44 referred to as a cold gap 44 is provided between the protruding portions 40 and the rim seal 38 along the overlap distance at ambient conditions. During operation of the gas turbine engine, the temperature rises and causes thermal expansion to close the cold gap 44. A light rub then occurs between the protruding portions 40 and the rim seal 38. This increases the sealing effect. Interference between the rim seal and the protruding portions results in abrasion of the rim seal abradable material and the creation of a notch 46.

The relative radial position of the flat portion 48 adjacent the notch 46 can be selected to arrive as flush as possible with the outer surface 50 of the blade platforms 26 and the outer surface 52 of the adjacent non-rotating structure 32 during operation of the engine, to minimize aerodynamic disruptions in the gas flow. A carefully selected flat portion 48 configuration can thus contribute to more closely obtain a smooth surface transition between the outer surface 50 of the blade platform 26 and the outer surface 52 of the non-rotating structure 32. The notch 46 can be machined prior to installation of the rim seal 38. Alternately, it can be carved in the rim seal 38 by abrasion with the protruding portions 40 during engine operation, or can be made by a combination of pre-machining and abrasion during operation.

In the illustrated example, a flanged support bracket 54, also made of sheet material, is connected to the end 36 and provides a support flange 56 on which the rim seal 38 can be brazed. The abradable rim seal 38 can be secured both to the flange 56 and to the end 36 of the non-rotating structure 32.

The above description is meant to be exemplary only, and one skilled in the art will recognize that changes may be made to the embodiments described without departing from the scope of the invention disclosed. For example, the annular rim seal can be used with other types of non-rotating structures than the one described and illustrated herein. Many different types of abradable materials exist and the exact choice thereof is left to those skilled in the art. The seal-holding bracket is optional, many different configurations can be used to connect the abradable rim seal to the edge of the non-rotating structure. Still other modifications which fall within the scope of the present invention will be apparent to those skilled in the art, in light of a review of this disclosure, and such modifications are intended to fall within the appended claims.

What is claimed is:

1. A rim seal and gas turbine engine arrangement, the arrangement comprising: a set of rotating blades having platforms extending axially aft therefrom, a non-rotating structure disposed adjacent to and downstream of the blade platforms and spaced apart therefrom to define an annular space between the blade platforms and the adjacent non-rotating structure, and a rim seal being mounted to the non-rotating structure and extending through the annular space towards the blade platforms, the rim seal having its outermost peripheral portion positioned radially inward of a rearwardly protruding portion of the blade platforms, the rim seal made of an abradable material, each said blade platform having a portion which, in use, is in engagement with said outermost peripheral portion of the rim seal for abrasion of the rim seal abradable material to close a gap between the protruding portion and the non-rotating structure by thermal expansion during operation to define a generally smooth gapless surface for an engine gas path.

2. The rim seal and gas turbine engine arrangement as defined in claim 1 wherein the non-rotating structure is made of sheet metal, the structure having an end partially defining the annular gap which is folded radially inwards, the abradable seal being connected to the end.

3. The rim seal and gas turbine engine arrangement as defined in claim 2 wherein the non-rotating structure comprises a seal-holding bracket secured to the end.

4. The rim seal and gas turbine engine arrangement as defined in claim 1 wherein the rim seal includes an annular notch in the rim seal cooperatingly mating with the blade platforms.

5. The rim seal and gas turbine engine arrangement as defined in claim 1 wherein the rim seal abradable material is configured to be abraded by the blade platforms during operation of the gas turbine engine.

6. The rim seal and gas turbine engine arrangement as defined in claim 1 wherein the abradable material is a honeycomb material.

7. An annular abradable rim seal and gas turbine engine arrangement for mitigating combustion gas ingestion on a side of blades in a gas turbine engine, the rim seal arrangement comprising a mounting portion mounted to a duct defining a portion of an engine gaspath with blade platforms upstream of the duct, the seal arrangement including a rim seal having an outermost peripheral portion opposite the mounting portion configured and disposed radially inward of a protruding portion of the blade platforms with an annular notch on a radially outer side of the rim seal facing the blade platforms to at least partially frictionally engage a plurality of the rotating blade platforms upstream of the duct during operation of the engine, to define a generally smooth surface for the engine gas path.

8. The rim seal and gas turbine engine arrangement as defined in claim 7 wherein a cold gap is provided between the blade platforms and the rim seal at ambient conditions; the cold gap being designed to close due to thermal expansion during operation of the gas turbine engine.

9. The rim seal and gas turbine engine arrangement as defined in claim 8 wherein the cold gap is sized to provide both a radial air restriction gap and an axial air restriction gap between the rim seal and the blade platforms.

10. The rim seal and gas turbine engine arrangement as defined in claim 7 wherein the duct further comprises a seal-holding bracket secured to a side thereof facing the blade platforms.

11. The rim seal and gas turbine engine arrangement as defined in claim 7 wherein the rim seal is honeycomb material.

* * * * *